US005643028A

United States Patent [19]

Craig

[11] Patent Number: 5,643,028

[45] Date of Patent: Jul. 1, 1997

[54] QUICK RELEASE SURF LEASH ASSEMBLY

[76] Inventor: James J. Craig, 777 NE. Harbour Dr., Boca Raton, Fla. 33431

[21] Appl. No.: 549,371

[22] Filed: Oct. 27, 1995

[51] Int. Cl.[6] ..... B63B 35/79

[52] U.S. Cl. ..... 441/75; 24/115 F; 24/170

[58] Field of Search ..... 441/75, 70; 24/115 F, 24/170

[56] References Cited

U.S. PATENT DOCUMENTS 2,920,366 1/1960 Pederson ..... 24/170
4,234,990 11/1980 Colburn ..... 441/75
4,285,083 8/1981 Wilson ..... 441/75
5,009,183 4/1991 Naypaver ..... 114/253

*Primary Examiner*—Sherman Basinger
*Attorney, Agent, or Firm*—Robert M. Downey, P.A.

[57] ABSTRACT

A surfboard leash assembly includes an ankle band and an elongate flexible cord having a first end releasably attachable to the ankle band and an opposite second end attachable to a surfboard. A lock mechanism on the ankle band includes a foot actuated switch operable between a locked position to maintain the first end of the cord attached to the ankle band and at least one unlocked position to release the first end of the cord so that, when under tension, the cord disconnects from the ankle band.

12 Claims, 4 Drawing Sheets

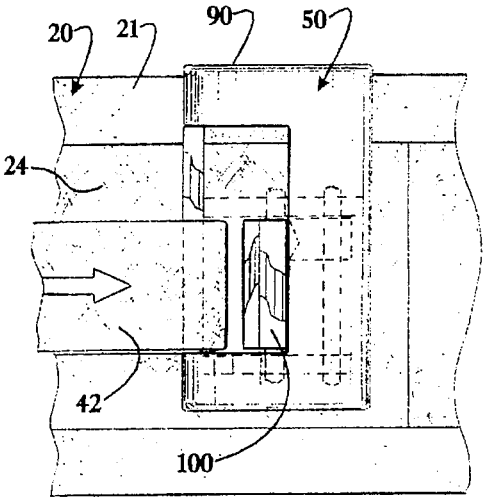
FIG. 12-A
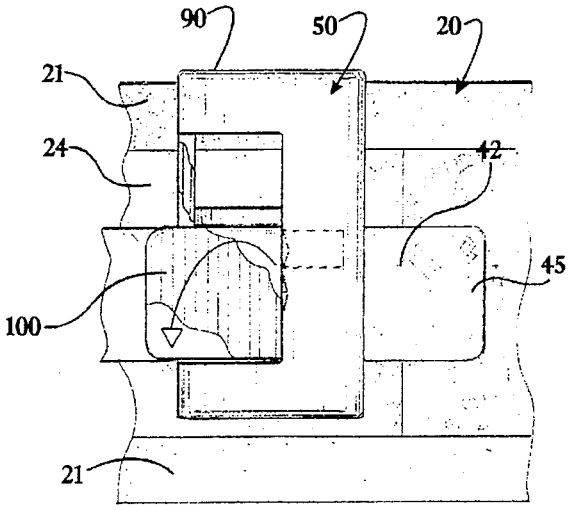
FIG. 12-B
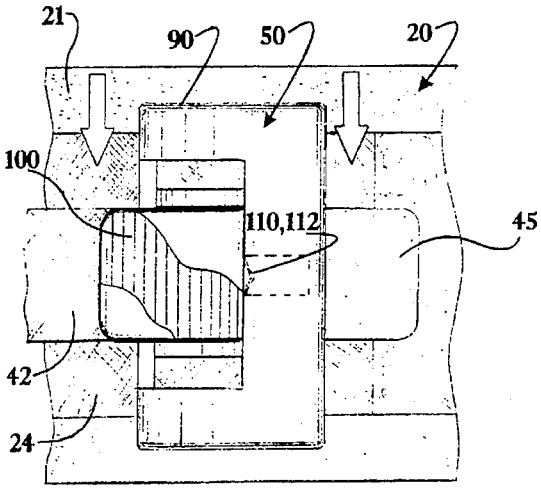
FIG. 12-C
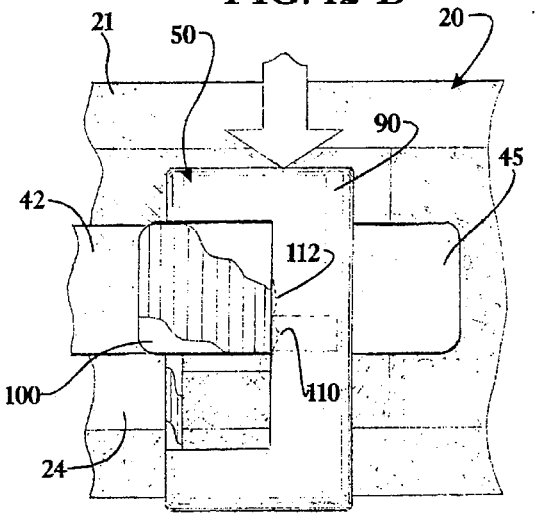
FIG. 12-D
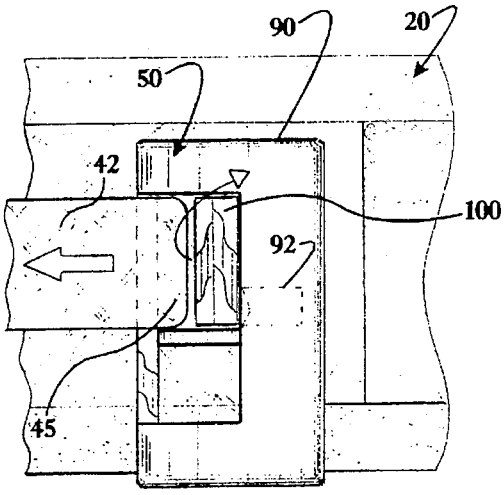
FIG. 12-E
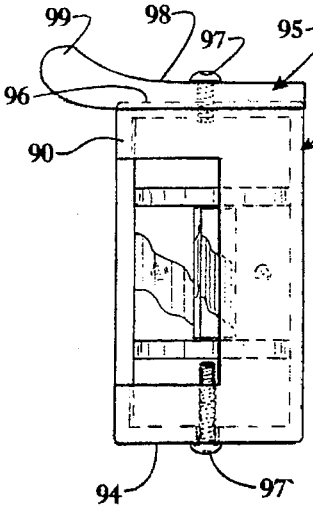
FIG. 13-A
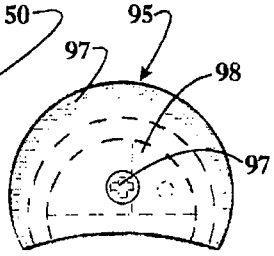
FIG. 13-B

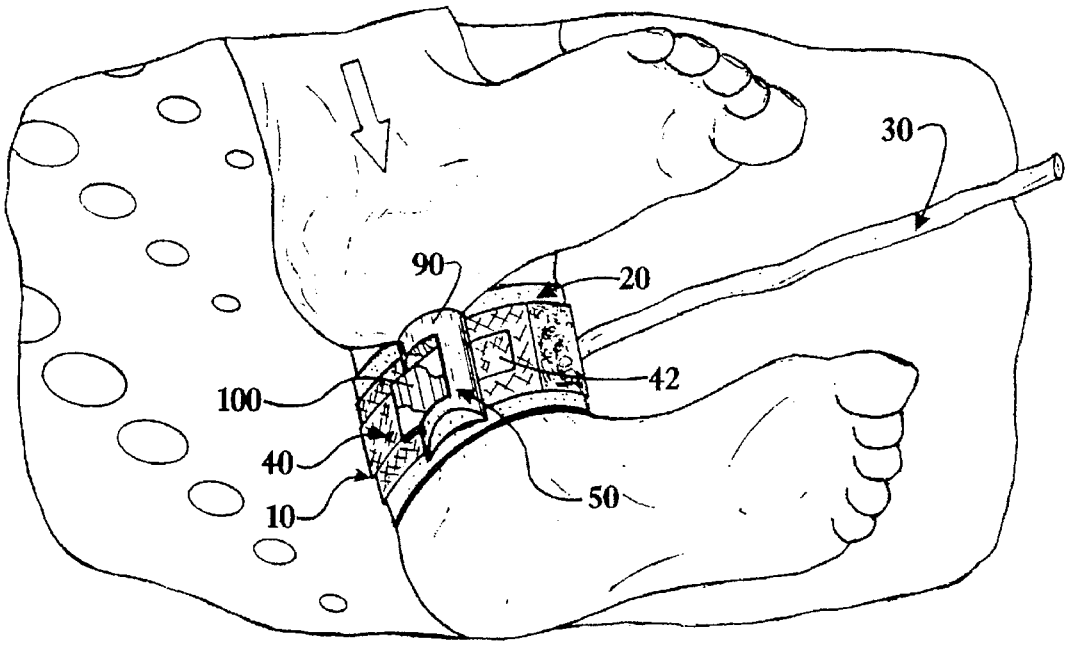
FIG. 14-A
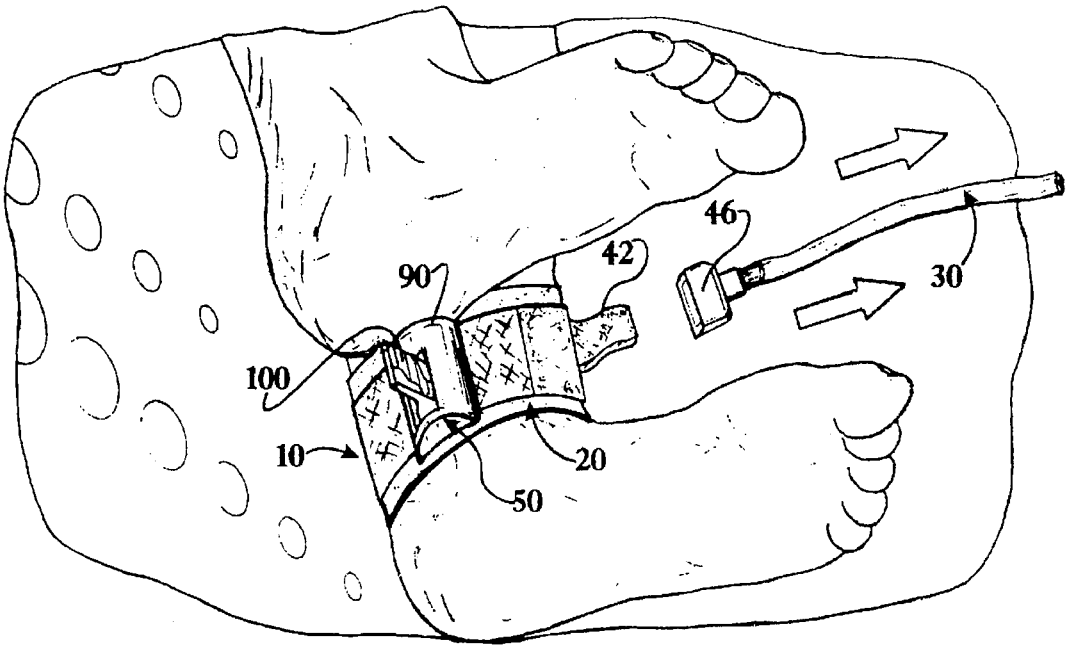
FIG. 14-B

QUICK RELEASE SURF LEASH ASSEMBLY

BACKGROUND OF THE INVENTION

1. Field of the Invention

This invention relates to surf leash devices for connection between a surfboard and a person's ankle and, more particularly, to a surf leash device having a quick release mechanism to rapidly disconnect a leash or cord from an ankle band of the device.

2. Description of the Related Art

In order to prevent a surfboard from being carried away by the waves when a surfer wipes out, which would require the surfer to swim great distances each time he/she takes a spill, most surfers wear a leash which connects the surfboard to their left or right ankle. The conventional surf leash consists of an elongate flexible cord which attaches to the surfboard at one end and to an ankle band or collar at the other end. The ankle band wraps around either ankle, depending on which foot is normally positioned rearwardly of the other, and is secured by overlapping velcro patches which maintain the ankle band securely on the ankle so that it will not separate or become detached even if heavy surf conditions. When wearing a surf leash, if a surfer wipes out, the surfboard will only be separated from the surfer by a length of the cord. The surfer can then simply swim to his/her surfboard or pull the cord to retrieve the surfboard.

The widespread use of surf leashes, especially in big surf, has had a positive influence in the reduction of deaths and injury. In the past, surfers have drowned from fatigue after having been forced to swim long distances in rough conditions to retrieve their board. In other instances, runaway surfboards have been known to strike the heads of unsuspecting surfers, causing serious injuries.

However, despite the positive impact of the use of surf leashes in the sport of surfing, the surf leash is also the culprit in many drownings and near death accidents which occur regularly around the world. Leash related deaths and accidents are primarily the result of the leash getting caught on an object underwater following even a routine wipe out. In other cases, the leash has been known to wrap around another surfer, pulling him/her underwater or into the white water of breaking waves. Incidents of this nature often lead to conscious drownings as the victim struggles unsuccessfully to reach the surface.

In recent years, the surf leash has been implicated in the deaths of quite a number of surfers, including a few professional surfers. In many of these accidents, rescuers discover that the leash had gotten hung-up on underwater objects, such as a reef, pipe, or piling, during a wipe out, as both the surfer and his surfboard plunged below the surface. When this happens, a person has, in most cases, less than a minute to get untangled and reach the surface. If the leash is severely caught, a surfer's only hope is to disconnect the leash from his ankle.

Presently, the leash or cord of conventional surf leash assemblies is fixedly secured to the ankle band. Thus, the only way to disconnect the leash from one's leg is to remove the ankle band by pulling and separating overlapping flaps or segments which attach to one another by velcro. This is not an extremely difficult task when one is sitting or standing casually on the beach. However, in a panic situation, when one has only seconds to blindly reach down and feel for the ankle band and find the overlapping flaps which need to be pulled apart, removal of the leash can be a life and death struggle. In fact, in some situations, particularly in heavy surf or current, it is impossible to bend and reach the ankle band with one's hands. This is because the force of the moving water is too great for the surfer to overcome when attempting to bend, grasp the ankle band and manipulate it for removal. It is a situation such as this where a surfer using a conventional leash is doomed.

To overcome this problem of leash removal in panic situations, several quick release devices have been developed in recent years. While most of these quick release devices help to overcome the problem of struggling to undue the ankle band with one's hands, they do not address the situation where it is impossible to reach the ankle band with one's hands. In fact, all of the known quick release leash devices require the user to pull a pin or tab by grasping it with one or more fingers.

Accordingly, there is an urgent need in the field of surfing for a quick release surf leash device which is hands-free and easily operated to disconnect the leash (cord) from the ankle band in virtually any situation.

SUMMARY OF THE INVENTION

The present invention is directed to a surfboard leash assembly for connection between a surfboard and a person's lower leg (ankle). The assembly includes a flexible leash or cord having a first end which releasably attaches to an ankle band, and an opposite second end which attaches to the surfboard. Attachment means are provided for releasably attaching the first end of the cord to the ankle band.

The leash assembly further includes lock means provided on the ankle band for locking engagement with the attachment means. The lock means includes a switch element which has a pressure application surface on opposite ends. This allows the ankle band to be worn on either the left leg or right leg to accommodate both goofey footers and regular footers. The switch is movable in response to pressure applied to the pressure application surfaces between a locked position, which causes the lock means to engage the attachment means, and an unlocked position causing the lock means to disengage the attachment means. In the locked position, the lock means maintains the first end of the cord attached to the ankle band, preventing removal therefrom. In the unlocked position, the lock means allows release of the first end so that the cord disconnects from the ankle band when under tension.

The switch element, comprising the opposite pressure application surfaces, is specifically designed to be movable using one's foot. Specifically, movement of the switch element is easily achieved by applying pressure against the pressure application surface of the switch element using the bottom of the foot on the leg opposite to the one on which the ankle band is attached. Because the switch element will be inversely oriented when wearing the ankle band on one leg as opposed to the other, the opposite pressure application surfaces accommodate for both regular footers (worn on right leg) and goofey footers (worn on left leg).

Accordingly, with the foregoing in mind, it is a primary object of the present invention to provide a quick release surf leash device for quickly and rapidly disconnecting the leash (cord) from the ankle band or collar of a surfboard leash assembly, without the use of one's hands or upper body.

It is a further object of the present invention to provide a quick release surf leash assembly which is easily and effectively operated using one's foot to effectively disconnect the cord from the ankle band.

It is still a further object of the present invention to provide a quick release surf leash assembly comprising a foot actuated lock mechanism to release the leash from the ankle band, wherein the lock mechanism is conveniently located on the ankle band and structured and configured so that it can be easily found and manipulated with the opposite foot in a panic situation.

It is still a further object of the present invention to provide a quick release surf leash assembly which is specifically structured for actuation using one's opposite foot to effectively release and disconnect the cord from the ankle band of the assembly in conditions where the user's mobility is severely restricted.

It is a further object of the present invention to provide a quick release surf leash assembly which is adapted to be worn, and which is equally effective on either the left ankle or right ankle, depending on user preference.

It is yet another object of the present invention to provide a surfboard leash assembly having a foot actuated quick release mechanism which is durable and adapted for regular exposure to salt water and sand.

It is yet a further object of the present invention to provide a quick release surf leash assembly which is relatively inexpensive to manufacture and which, therefore, can be sold at a retail price comparable to that of conventional surf leashes.

These and other objects and advantages of the invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIGS. 12A–12E illustrate, in plan view, a sequence of locking engagement and disengagement of the lock means with attachment means to secure the cord to the ankle band and release the cord respectively;

FIG. 13A is a front elevation of the lock means showing a foot plate attached to the switch element to define a pressure application surface;

FIG. 13B is a top plan view of the foot plate; and

FIGS. 14A and 14B illustrate the manner of normal use and operation of the surfboard leash assembly to effectively disconnect the cord from the ankle band and the user.

Like reference numerals refer to like parts throughout the several views of the drawings.

DETAILED DESCRIPTION OF THE PREFERRED EMBODIMENT

Figure 1:
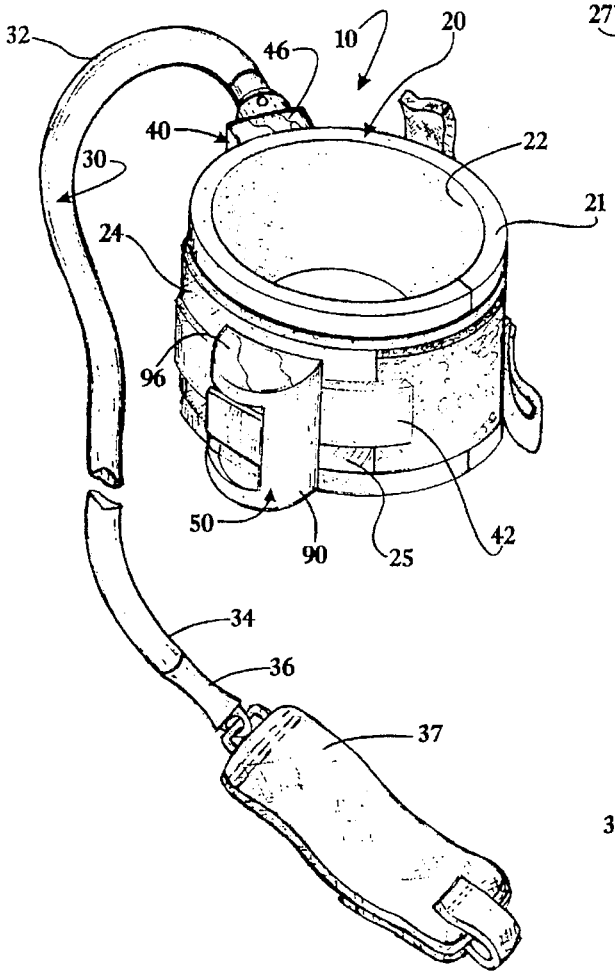
FIG. 1 is a perspective view of the surfboard leash assembly of the present invention.

Referring to the several views of the drawings, and initially FIG. 1, a preferred and practical embodiment of the surfboard leash assembly is shown, generally indicated as 10. The surfboard leash assembly 10 includes an ankle band 20 or collar which is structured to wrap around a user's ankle to form a closed loop. The ankle band 20 is secured about the user's ankle by hook and loop fasteners at opposite ends of the ankle band 20. In the preferred embodiment, the ankle band is provided with a neoprene layer 21 providing a comfortable inner facing surface 22 which mates against the skin of the wearer's lower leg (ankle). The ankle band 20 is further provided with a second layer 24 which is comprised of a durable, wear-resistant material such as a woven nylon material webbing, providing an outer facing surface 25 suitable for mounting component elements of the assembly, as described hereinafter. The outer, durable layer 24 can be stitched to the inner layer 21 to provide an integral band unit.

The surfboard leash assembly 10 further includes a flexible, elongate cord 30 or leash having a first end 32 and an opposite second end 34. The second end 34 of the leash 30 is provided with a swivel fitting 36 which attaches to a tether 37. The tether 37 is of a conventional type and is specifically suited for attachment to a conventional fitting on a surfboard. The cord 30 may be formed of solid core rubberized plastic or other suitable material which is durable and flexible. The first end 32 of the cord 30 is provided with an attachment fitting in accordance with an attachment means 40, to be described more fully hereinafter.

The ankle band 20 is further provided with a lock mechanism 50 mounted to the outer durable layer 24 on the outer facing side 25 of the ankle band 20. The lock mechanism, as described hereinafter, is specifically structured to lockingly engage and disengage with the attachment means. When engaged with the attachment means, the lock mechanism 50 maintains cord 20 in attachment with the ankle band 20. This engagement of the attachment means by operation of the locking mechanism 50 results in quick release of the cord 20 from the ankle band and, accordingly, the user.

Figure 3:
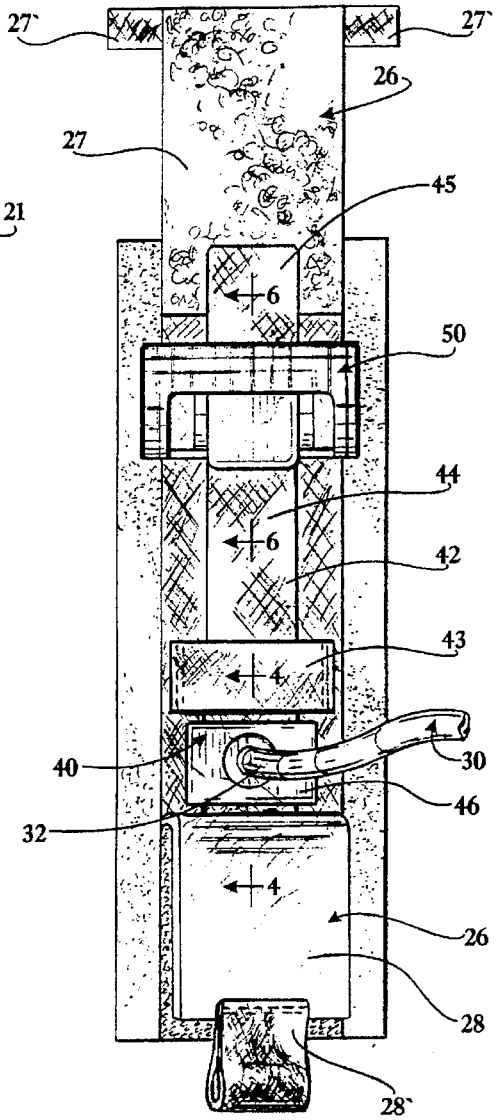
FIG. 3 is a top plan view of an ankle band of the leash assembly, shown with one end of the cord attached thereto.
Figure 2:
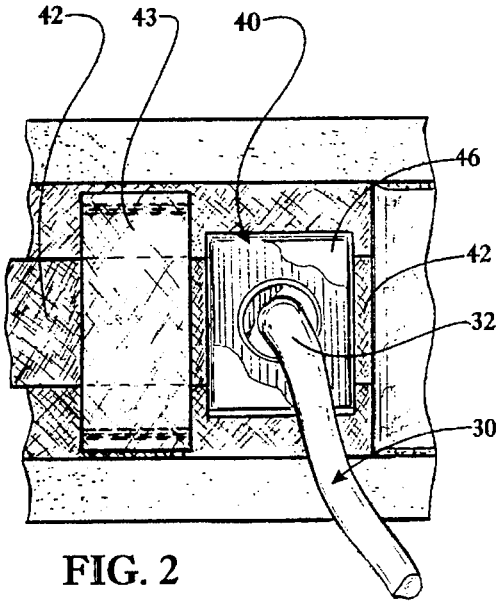
FIG. 2 is an isolated plan view showing the end of the cord attached to the ankle band by attachment means of the invention.

Referring to FIG. 3, a preferred and practical embodiment of the ankle band 20 is shown including a securing system 26 on opposite ends thereof for securely fastening the ankle band 20 about a user's ankle. The securing system 26 includes a first extending flap 27 attached at one end to the outer durable layer 24. The flap 27 is provided with tabs 27' to facilitate grasping. The opposite end of the ankle band 20 is provided with a fold-over flap 28 having a tab 28' on a free edge thereof. Both the opposite surfaces of the flap 27 and the inner confronting surfaces of the fold-over flap 28 are provided with hook and loop fastening material, such as velcro. In use, once the ankle band 20 is wrapped around the user's ankle, so that the opposite ends of the ankle band 20 are brought together, the flap 27 is placed between confronting surfaces of the fold-over flap 28 (while the fold-over flap 28 is open). The fold-over flap 28 is thereafter folded down to sandwich the flap 27 between the confronting surfaces, as the hook and loop fastening material engages both sides of the flap 27 holding it therebetween. To remove the ankle band, the wearer must first pull the tab 28' to open the fold-over flap 28 and thereafter pull on either of the tabs 27' to detach the flap 27 from the hook and loop fastening material on the inner facing surface of the fold-over flap portion which is attached to the outer layer 24.

Referring to FIGS. 2–5, the attachment means 40 of the preferred embodiment is shown to include a strap 42 formed of a durable, tear-resistant material similar to that of the outer layer 24. The strap 42 is securely attached at one end zone (not shown). This is preferably accomplished by stitching the end zone of the strap 42 to the outer durable layer 24 of the ankle band 20, underneath the fold-over flap 28. The strap 42 further includes a mid-length portion 44 which feeds through an attachment fitting 46 on the end 22 of the cord 20, and terminates at a free distal end 45. A belt loop 43 may be provided on the outer facing surface 25 of the ankle band 20 to hold the mid-length portion 44 of the strap 42 against the outer facing surface 25 of the layer 24 on the ankle band 20. The distal end 45 of the strap 42 is fed through the lock mechanism 50 and, once pulled tight, is locked in position by operating the lock means 50 to engage the strap 42 so that the distal end 45 cannot be withdrawn through the lock mechanism 50. In this position, the attachment fitting 46, to which the cord 30 is affixed, is held firmly against the ankle band 20 and cannot be removed therefrom.

Figure 4:
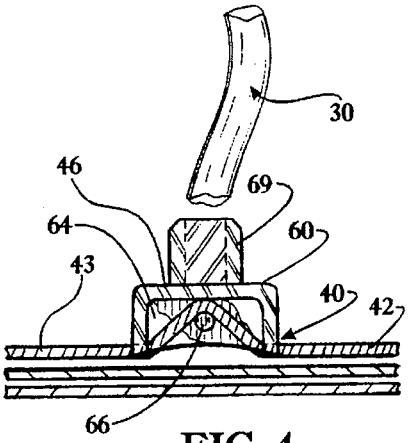
FIG. 4 is a sectional view taken along the plane indicated by the line 4—4 in FIG. 3, illustrating the manner of attachment of the cord to the ankle band in more detail.
Figure 5:
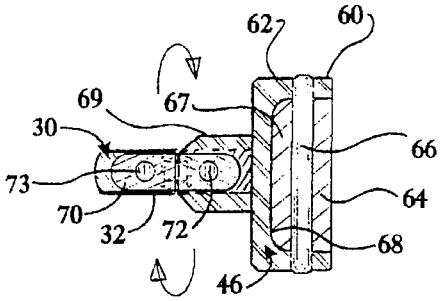
FIG. 5 is an isolated sectional view of the end of the cord which attaches to the ankle band, showing a swivel and attachment fitting thereon.

As seen in FIGS. 4 and 5, the attachment fitting 46 includes a housing 60 formed of a hardened, durable, non-corrosive material. An enlarged portion 62 of the housing 60 includes an open bottom face exposing a cavity 64. A pin 66 formed of a high-strength, non-corrosive material such as stainless steel, is secured at opposite ends to the housing 60 and extends through the cavity 64 forming a gap 67 between the pin 66 and an interior surface 68 of the enlarged portion 62. As best seen in FIG. 4, the strap 42 feeds through the gap 67, between the pin 66 and inner surface 68 so that when the strap 42 is pulled tight, the open bottom of the enlarged portion 62 is brought against the outer facing surface 25 of the ankle band 20, effectively attaching the housing 60 to the ankle band 20.

The housing 60 is further provided with a hollow cylindrical stem 69 integrally formed with the enlarged portion 62 and adapted for fitted, attached receipt of the distal end 32 of the cord 30 therein. As seen in FIG. 5, the distal end 32 of the cord 30 may be provided with a swivel fitting 70 which partially extends and attaches within the hollow stem 69 of the housing 60 by a pin 72. An opposite half of the swivel fitting 70 is embedded within the end of the cord 30 and secured with a pin 73 or other suitable hardware. In this manner, the cord 30 is free to rotate relative to the attachment fitting 46 and ankle band 20, preventing the cord from developing kinks.

Referring to FIGS. 6–11, the lock mechanism 50 of the assembly 10 is shown in detail and includes a base element 80 which is fastened to the outer durable layer 24 on the ankle band 20 by rivets or like fasteners 81. The base element 80 includes a bottom plate 82 which mates with the outer facing surface 25 of the layer 24 of the ankle band 20, and opposite side walls 84, 86 disposed in spaced, parallel relation to define a channel 88 therebetween (see FIG. 8). A pin 89 is fixed at opposite ends to the side walls 84, 86 and extends across the width of the channel 88.

Figure 9:
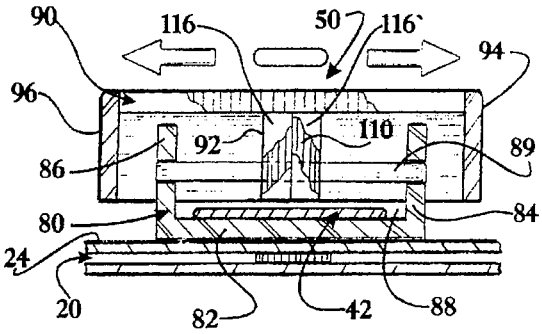
FIG. 9 is a sectional view taken along the plane indicated by the line 9—9 in FIG. 6.
Figure 11:
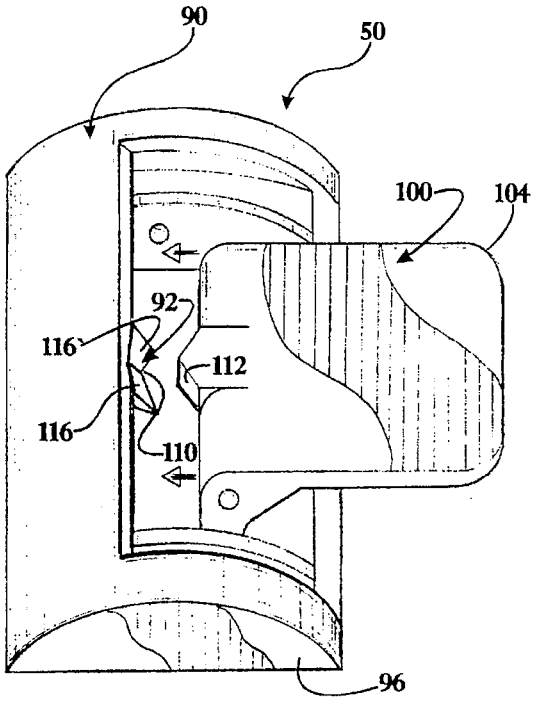
FIG. 11 is an isolated perspective view of the lock means.

A switch element 90 having a generally half cylindrical configuration is movably mounted on the base element 80 and is slidably maintained on the pin 89 so as to be movable as indicated by the arrows in FIG. 9. The pin 89 extends through a centrally disposed, downwardly depending rib 92 integrally formed on an underside of the switch element 90. The opposite ends 94, 96 of the switch element 90 are provided with a substantially flat surface (as best seen in FIGS. 1 and 11), defining a pressure application surface at each of the opposite ends 94, 96, respectively. By applying pressure directly on the pressure application surface of the opposite ends 94, 96, the switch element 90 is caused to move along the length of the pin 89, as the centrally disposed rib 92 moves between the opposite walls 84, 86 of the base element 90.

Figure 6:
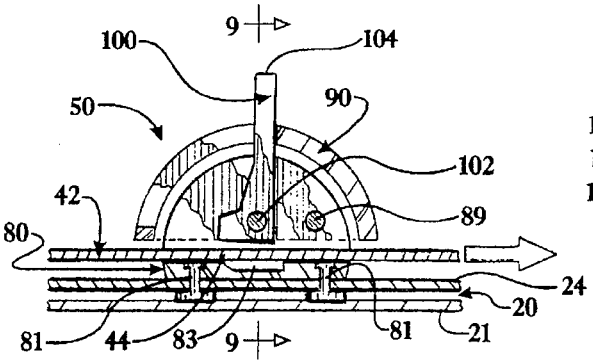
FIGS. 6 and 7 are isolated sectional views taken along the plane indicated by the line 6—6 in FIG. 2, showing lock means of the assembly.
Figure 10:
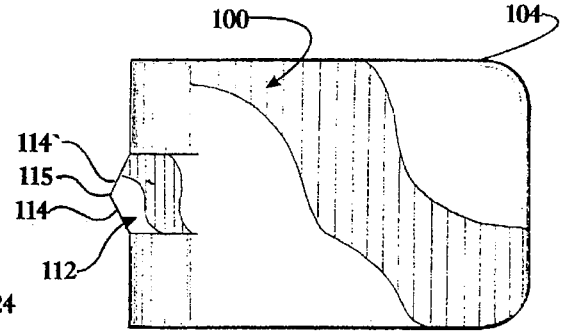
FIG. 10 is a top plan view of a lever of the lock means.
Figure 7:
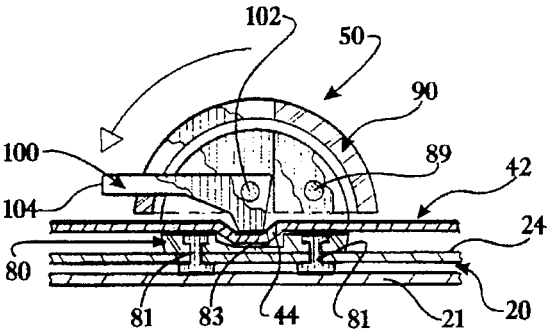

As best seen in FIGS. 6–8, 10 and 11, the lock mechanism 50 further includes a lever 100 which hingedly mounts between the opposite walls 84, 86 of the base element 80 on a pin 102 which extends between and is affixed to the opposite walls 84, 86. The lever 100 is swingable through a range of movement of approximately 90° from a disengaged position, as seen in FIG. 6, to an engaged, locking position, as seen in FIG. 7. In the engaged, locking position, the free edge 104 of the lever 100 is moved towards the ankle band 20, as seen in FIG. 7, so that a flanged head 106 of the lever 100 engages the strap 42 within the channel 88, depressing the mid-length 44 of the strap 42 within a recessed portion 83 of the base plate 82. In this position, with the strap pinned within the recessed portion 83, as seen in FIG. 7, movement of the strap 42 through the channel is prevented.

Figure 8:
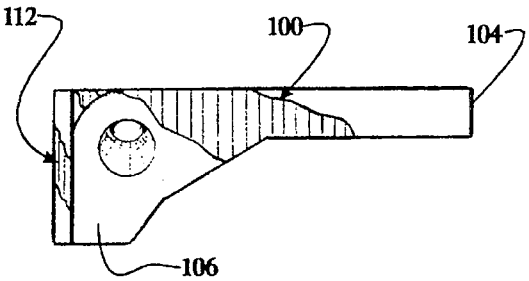
FIG. 8 is a side elevation of the lever of the lock means.

To maintain the lever 100 in the locked position of FIG. 7, the rib 92 on the switch element 90 and the lever 100 are provided with confronting, congruently configured faces 110, 112, respectively. The confronting face 112 on the lever 100 comprises substantially flat surfaces 114, 114' angled outwardly from the lever 100 and meeting at an apex 115. The face 110 of the rib 92 comprises flat surfaces 116, 116' angled inwardly, as seen in FIGS. 8 and 11. When the lever 100 is down, as seen in FIG. 7, and the switch element 90 is moved into the locked position, the surfaces 114, 114' and 116, 116' on the respective confronting faces 112, 110, are disposed in mating, confronting engagement. This prevents the free edge 104 of the lever 100 from being lifted to the position shown in FIG. 6, and thus the lever 100 is maintained in the down, locked position, engaging the strap 42 to prevent removal thereof from within the locking mechanism 50.

Upon applying pressure to the pressure application surfaces of either of the opposite ends 94, 96 of the switch element 90, the switch element 90 is caused to move along the pin 89 resulting in separation of the confronting faces 110, 112 on the rib and lever 100, respectively, as the rib moves to either side of the channel 88 adjacent one of the opposite walls 84, 86. Movement in this manner, resulting in separation of the confronting faces 110, 112 defines an unlocked position, allowing the strap 42 to be pulled through the channel 88. Movement of the strap 42 by a pulling force applied thereto, will result in the lever 100 swinging upwardly or open, as seen in FIG. 6.

As the apex 115 on the confronting face 112 of the lever 100 passes over the opposite edges of the confronting face 110 of the rib, there is a frictional engagement which provides a snap-fit feel to indicate engagement and disengagement of the confronting faces 110 and 112 and thus locking and unlocking of the switch element 90 with the lever 100. Thus, the angle of the surfaces 114, 114', and thus the amount of protrusion of the apex 115 from the lever 100 will determine the amount of force necessary to be exerted on the pressure application surfaces of the switch element 90 to disengage the lock mechanism 50 from the attachment means 40 and, accordingly, to release the cord 30 from the ankle band 20, as described hereinafter.

The sequence of operation to engage and disengage the locking mechanism 50 with the strap 42 of the attachment means 40 is shown in FIGS. 12A through 12E. To begin, the strap 42 is fed through the cavity 64 and between the pin 66 and interior surface 68 of the housing 60 of the attachment element 46 on the end 32 of the cord 30. Thereafter, the distal end 45 of the strap 42 is fed through the locking mechanism 50, in the direction of the arrow of FIG. 12A, so that the strap 42 passes through the channel 88 of the base element 80, below the lever 100, as the lever is maintained in the up position. Once exiting the channel 88 on the opposite side of the locking mechanism 50, the distal end 45 of the strap 42 is grasped and pulled tight so that the attachment element 46 on the cord 30 is pulled firmly against the outer facing surface 25 of the ankle strap 20. Maintaining the strap 42 pulled tight, the lever 100 is lowered so that the flanged head of the lever engages the strap 42 (as described above) as seen in FIG. 12B. While maintaining the lever in the down, strap engaging position, the switch element 90 is moved from the unlocked position to the locked position so that the confronting faces 110, 112 on the rib 92 and lever 100 respectively, are moved into confronting engagement, as seen in FIG. 12C. In this position, the strap 42 is locked in the locking mechanism 50 and cannot be withdrawn therefrom. To this point, the sequence for attaching the cord 30 to the ankle band 20 has been described.

If it is necessary to rapidly disconnect the cord 30 from the ankle band 20, in accordance with a quick release mode of operation of the invention, the user simply exerts a downward force on the pressure application surface of either end 92, 94 of the switch element 90, as illustrated in FIG. 12D. In use, this action is accomplished by pressing on the pressure application surface of the switch element 90 with the bottom of the opposite foot as seen in FIG. 14A. Upon moving the switch element 90 to the unlocked position, the strap 42 will immediately be pulled by the slightest tension on the cord 30, resulting in movement of the strap 42 in the direction indicated in FIG. 12E. This will cause the strap to be separated from the attachment element 46 on the end of the cord 30 so that the cord 30 is immediately and effectively separated from the ankle band 20, as shown in FIG. 14B.

In order to provide a larger, more accessible pressure application surface on the switch element 90, a foot plate 95 may be used. The foot plate 95 attaches to either end 94, 96 of the switch element 90 (depending on which leg the ankle band 20 is worn) using screws 97', 97 respectively. The screws 97, 97' are normally left attached to the opposite ends 96, 94 of the switch element 90. To attach the foot plate 95 to either end 94, 96, the appropriate 97, 97' is removed, the foot plate 95 is placed on the end of the switch element 90 and the screw 97 or 97' is replaced to secure the foot plate on the switch element 90.

The foot plate 95 includes a top surface 98 structured and configured to provide an enlarged area for engagement with the bottom of the user's foot, and thus defines the pressure application surface of the switch element 90. A raised peripheral rim 99 about the outer periphery of the foot plate 95 helps to prevent the user's foot from slipping off of the top surface 98 when applying downward pressure thereon.

While the instant invention has been described in what is considered to be a preferred and practical embodiment, it is recognized that departures may be made within the spirit and scope of the invention which is not to be limited except as set forth in the following claims and within the doctrine of equivalents.

Now that the invention has been described,

What is claimed is:

1. A surfboard leash assembly for connection between a surfboard and a person's lower leg, said assembly comprising:

an ankle band structured to be secured about the person's lower leg and including an outer facing side and an inner facing side, an elongate flexible cord including a first end and an opposite second end, attachment means for releasably attaching said first end of said cord to said ankle band, and lock means on said ankle band for locking engagement with said attachment means and including a foot-actuated switch having at least one pressure application surface structured and disposed for engagement with the bottom of the person's foot for applying pressure thereto, said switch being movable in response to pressure applied to said pressure application surface between a locked position to cause the lock means to engage said attachment means, maintaining said first end of said cord attached to said ankle band, and at least one unlocked position to cause the lock means to disengage said attachment means and release said first end so that said cord disconnects from said ankle band.

2. A surfboard leash assembly as recited in claim 1 wherein said attachment means includes:

a strap having a proximal end zone attached to said outer facing of said ankle band, a free distal end and a mid-length extending between said proximal end and said free distal end, and a fitting on said first end of said cord and structured for removable receipt of said strap therethrough so that said fitting is held secure against said outer facing side of said ankle band when said strap is pulled tight in overlying relation to said outer facing side.

3. A surfboard leash assembly as recited in claim 2 wherein said lock means includes:

a base member fixedly secured to said ankle band and including a channel for receipt of said mid-length of said strap therein, a locking lever hingedly attached to said base member and movable between an open position to permit sliding passage of said distal end and said mid-length of said strap through said channel and a closed position to hold said mid-length of said strap in said channel, and said switch being movably mounted to said base and including means thereon for locking engagement with said lever when said switch is in said locked position, thereby holding said lever in the closed position.

4. A surfboard leash assembly as recited in claim 3 wherein said means on said switch for locking engagement with said lever includes a rib having a confronting face adapted for congruent, confronting engagement with a corresponding confronting face on said lever when in said locked position, thereby preventing movement of said lever from said closed position to said open position.

5. A surfboard leash assembly as recited in claim 1 wherein said switch includes first and second oppositely disposed pressure application surfaces that said ankle band can be worn on either leg of the person, with the lock means inversely oriented.

6. A surfboard leash assembly as recited in claim 5 wherein said switch includes a removably attachable foot plate having a top surface defining said pressure application surfaces.

7. A surfboard leash assembly comprising:

an ankle band including an outer facing side and an inner facing side, an elongate flexible cord having a first end and an opposite second end, attachment means for releasably attaching said first end of said cord to said ankle band, lock means for locking engagement with said attachment means and including foot actuated means for operating said lock means from a locked position wherein said lock means is disposed in engagement with said attachment means, maintaining said first end of said cord attached to said ankle band, to at least one unlocked position to disengage said attachment means and release said first end so that said cord disconnects from said ankle band, and said lock means including a switch element slidably movable between said locked position and said unlocked position and having at least one pressure application surface structured and disposed for engagement with the bottom of the person's foot on the leg opposite to the leg on which said ankle band is worn for applying pressure thereto, wherein pressure applied to said pressure application surface results in movement of said switch element from said locked position to said at least one unlocked position.

8. A surfboard leash assembly as recited in claim 7 wherein said switch element includes first and second oppositely disposed pressure application surfaces.

9. A surfboard leash assembly for connection between a surfboard and a person's lower leg, said assembly comprising:

an ankle band structured to be secured about the person's lower leg and including an outer facing side and an inner facing side, an elongate flexible cord including a first end and an opposite second end, attachment means for releasably attaching said first end of said cord to said ankle band, lock means on said ankle band for locking engagement with said attachment means and including a foot actuated switch movable in response to pressure applied thereto by the person's foot on the leg opposite to the leg on which said ankle band is worn to cause movement of said lock means from a locked position, wherein said lock means is disposed in engagement with said attachment means maintaining said first end of said cord attached to said ankle band, to at least one unlocked position to cause said lock means to disengage said attachment means and release said first end so that said cord disconnects from said ankle band, said switch including first and second oppositely disposed pressure application surfaces, said first and second pressure application surfaces each being structured and disposed for engagement with the bottom of the person's foot, wherein application of a force applied by the person's foot on either of said first and second pressure application surfaces results in movement of said switch from said locked position to said at least one unlocked position, and said switch including a removably attachable foot plate having a top surface defining said pressure application surfaces.

10. A surfboard leash assembly as recited in claim 9 wherein said foot plate is selectively attachable to either a first end of said switch or an opposite second end of said switch.

11. A surfboard leash assembly as recited in claim 9 wherein said attachment means includes an attachment fitting fixedly secured to said first end of said elongate flexible cord and being structured and disposed for attached engagement on said ankle band.

12. A surfboard leash assembly as recited in claim 11 wherein said attachment fitting is secured to said first end of said elongate flexible cord by a swivel fitting, enabling rotation of said attachment fitting relative to said elongate flexible cord.

* * * * *